US007641552B2

(12) United States Patent
Manz

(10) Patent No.: US 7,641,552 B2
(45) Date of Patent: Jan. 5, 2010

(54) PLAYER ACTUATED INPUT FOR A GAMING MACHINE

(75) Inventor: Robert Manz, Las Vegas, NV (US)

(73) Assignee: Rocket Gaming Systems, LLC, Grove, OK (US)

( * ) Notice: Subject to any disclaimer, the term of this patent is extended or adjusted under 35 U.S.C. 154(b) by 282 days.

(21) Appl. No.: 11/081,107

(22) Filed: Mar. 15, 2005

(65) Prior Publication Data

US 2006/0211497 A1 Sep. 21, 2006

(51) Int. Cl.
*A63F 9/00* (2006.01)

(52) U.S. Cl. ..... 463/37; 463/19; 463/20

(58) Field of Classification Search ..... 463/37
See application file for complete search history.

(56) References Cited

U.S. PATENT DOCUMENTS 4,010,956 A * 3/1977 Zyla et al. ..... 273/246
4,095,795 A * 6/1978 Saxton et al. ..... 463/20
4,174,833 A * 11/1979 Hennig et al. ..... 273/442
4,231,571 A * 11/1980 Watanabe ..... 273/442
4,373,727 A 2/1983 Hooker et al.
4,474,372 A * 10/1984 Karasawa ..... 273/442
4,487,510 A 12/1984 Buurman et al.
4,926,172 A * 5/1990 Gorsek ..... 341/20
5,062,647 A * 11/1991 Chanter et al. ..... 273/442
6,217,445 B1 * 4/2001 Inoue ..... 463/6
6,384,834 B1 * 5/2002 Watanabe ..... 345/582
6,398,647 B1 * 6/2002 Hirai et al. ..... 463/31
6,417,856 B1 * 7/2002 Tamura et al. ..... 345/474
6,590,176 B2 7/2003 Cole et al.
6,805,604 B2 * 10/2004 Brumagin et al. ..... 446/37
2003/0073473 A1 * 4/2003 Mori ..... 463/6
2003/0111330 A1 6/2003 Cole et al.
2004/0118669 A1 6/2004 Mou

* cited by examiner

*Primary Examiner*—Corbett Coburn
*Assistant Examiner*—Seng H Lim
(74) *Attorney, Agent, or Firm*—Weide & Miller, Ltd.

(57) ABSTRACT

An input device is movable between at least two positions. Movement of the input device results in generated of an least two inputs, such as two signals. When associated with a gaming machine, movement of the input device by a player is used to provide multiple inputs to a gaming controller for playing a game. The input device may be used to present a game, such as a Class II bingo type game where a player is required to provide multiple inputs over the course of the game in order to participate in the game.

4 Claims, 3 Drawing Sheets

PLAYER ACTUATED INPUT FOR A GAMING MACHINE

FIELD OF THE INVENTION

The present invention relates to gaming machines and, more particularly, methods and devices for accepting player input at such machines.

BACKGROUND OF THE INVENTION

Commercial or "wager" based gaming continues to grow in popularity. A variety of gaming machines have been developed over the years for presenting games offering a chance for the player to win an award of monies or a representation of monetary value. These machines include old mechanical slot machines, newer electro-mechanical slot machines, as well as video gaming machines such as video poker machines.

Federal laws define several types of gaming. One type is known as Class II gaming, and another is Class III gaming. Regardless of whether a game is a Class II or Class III type game, commonality exists in that a player is required to place a wager to be entitled to play the game, and a player has the opportunity to win an award depending upon the outcome of the game.

All gaming machines include one or more devices for accepting player input. For example, slot machines often include a "spin" button or an "arm." Depressing the spin button or pulling the arm is associated with a single particular input, that of effecting rotation of the physical or simulated reels of the slot machine. Video poker machines include "hold" buttons which each define a singular, unique input, that of designating a card to be held in a draw poker game.

According to the statutory definition, Class II gaming includes the game of chance commonly known as bingo, whether or not electronic, computer or other technologic aids are used in connection therewith. 25 U.S.C. § 2703(7). In accordance with statutory definition and interpretation thereof, the game of bingo requires multiple players to cover number or other designations on a card, and at least one winner comprising the player(s) who are the first to achieve a designated cover arrangement.

Class II gaming is very important and there is a strong desire for Class II games. Among other things, the Indian Gaming Regulatory Act (25 U.S.C. § 2701 et. seq.) provides that an Indian tribe may engage in Class II gaming where the state in which it is located permits similar games and such gaming is not otherwise specifically prohibited on Indian lands by Federal law. 25 U.S.C. § 2710(b)(1)(A). Thus, in accordance with this Act, though Class III gaming may be prohibited in certain locations, at those same locations, Class II games may be permitted. As a result, there is a substantial desire to produce, and a substantial demand for, Class II games.

Currently, various implementations of Class II games exist. In one implementation of a bingo-based Class II game, a player must provide multiple inputs in order to initiate the game and participate in the game. In particular, a player must first provide a "play" input in order to indicate a desire to participate in the multi-player game. Each player of the game is assigned a bingo card and one or more balls are drawn. In order for a player's card to be marked or "daubed" in the event selected balls match numbers on the player's card, the player must provide a "daub" input.

Generally, play of the game continues until a player receives a game-ending winning pattern. Normally, the number of balls which are initially drawn total less than the number which are necessary to receive the game-ending pattern. Thus, after the initial one or more balls are drawn, additional balls are drawn until one or more players of the game receive the game-ending "bingo" pattern outcome. In this configuration, each time additional balls are drawn, the player must again provide a "daub" input in order to mark matching drawn ball numbers with their card numbers. In some instances, a player must also provide a "claim" input in order to claim winnings when a winning pattern is received. These game initiating, daub and claim inputs are provided by individual instances of a player depressing one or more buttons on the gaming machine.

As with all games, it is desireable to make Class II bingo games more exciting. For example, Class II game results are now often represented by secondary, exciting events. The outcome of a bingo game may be represented as a winning or losing spin of simulated slot reels. In this configuration, the player gets to experience the bingo game as a slot-type event, including the excitement of having the reels spin and awaiting the results of the spin in order to learn of the outcome of the game. Unfortunately, the button presses required of the player in order to play the bingo portion of the game detracts from the game play experience, especially when the game outcome is represented as another event.

SUMMARY OF THE INVENTION

The invention comprises a input device, a gaming machine including one or more input devices in accordance with the invention, and methods of using the input device as part of the presentation of a game, the method including accepting player input via an input device.

One aspect of the invention is an input device. In one embodiment, the input device is movable, and movement of the input device generates at least two inputs, such as two electric signals.

The input device preferably comprises a body moveable between a least a first position and a second position. The input device includes at least one signal generating element and movement of the input device from one position to another causes at least two signals to be generated by the at least one signal generating element. In a preferred embodiment, the input device includes a first signal generating element and at least a second signal generating element. When the body is moved to a first position the first signal generating element generates a first input signal, and when the body is moved to a second position the second signal generating element to generates a second input signal.

In one embodiment, the input device is a rotatable arm. Movement of the arm from a starting position to a rotated position and back to the starting position is associated with at least two inputs. In one embodiment, one or more positions between the starting position and a fully rotated position define an input position, whereby movement of the arm results in three, four or more inputs.

In another embodiment the input device is a slider which is movable along a linear slot. Movement of the slider along the slot from one position to another, such as from one end of the slot to the other, results in two or more inputs.

In one embodiment, the input device is associated with a gaming machine which is configured to accept player inputs and present information to a player regarding a game. In this configuration, a player provides multiple inputs to the gaming machine via the multi-position input device. These inputs may comprise signals provided to a gaming controller of the gaming machine.

Another embodiment of the invention is a method of presenting a game to a player of a gaming machine. In one embodiment, the game is a Class II game and, more particularly, a bingo-based game. In one embodiment, the game includes the steps of accepting a first input from a player to enter a game, presenting a game to the player at the gaming machine including displaying a game card bearing player numbers, generating a first set of one or more game numbers, accepting a second input from the player to daub the game card and indicate matches of any game numbers from the first set of game numbers with player numbers, generating a second set of one or more game numbers, accepting at least a third input from the player to complete play of the game, and determining if the player received any winning game combinations, where at least two of the inputs are provided by the player moving a multi-position input device from at least a first position to a second position.

Further objects, features, and advantages of the present invention over the prior art will become apparent from the detailed description of the drawings which follows, when considered with the attached figures.

DETAILED DESCRIPTION OF THE INVENTION

The invention is a player actuated input device, such as for a gaming machine, and a method of receiving one or more player inputs, such as in a gaming environment. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is an input device which is movable between or to multiple positions. A preferred embodiment of the invention is an input device which, when moved, generates multiple inputs. Yet another embodiment of the invention is a method of receiving one or more inputs from a player and a method of providing inputs to a gaming machine.

Figure 1:
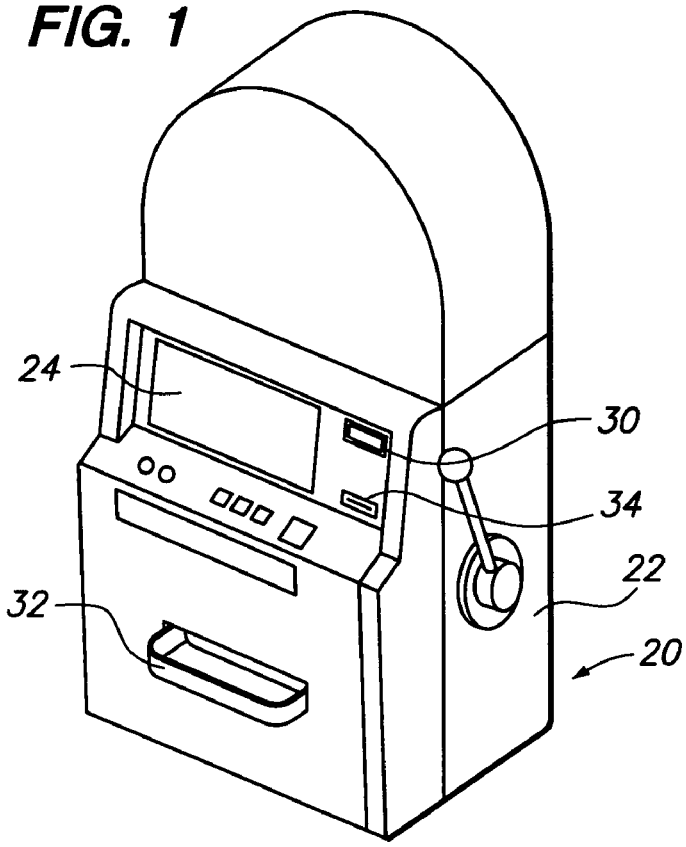
FIG. 1 illustrates a gaming machine comprising one environment of use of the present invention, the gaming machine including an input device in accordance with an embodiment of the invention.

The input devices of the invention are preferably associated with a gaming machine, and the methods of the invention are particularly suited to practice in conjunction with a gaming machine. FIG. 1 illustrates one example of a gaming machine which may comprise a component or environment of the invention. Of course, the gaming machine may vary from that illustrated and described.

As illustrated, the gaming device or machine 20 includes a housing 22 containing or supporting various components. The gaming machine or device 20 is, either alone or in combination with other devices, preferably configured to present a game, such as a game of the invention. It will be appreciated that the housing 22 may have a variety of shapes and configurations. For example, the gaming machine 20 may be configured as an "upright," "bar-top" or "slant" style gaming machine, which configurations are well known in the industry.

As illustrated, the gaming machine 20 includes means for displaying symbols or indicia utilized in the play or presentation of a game. In a preferred embodiment, the gaming machine 20 is configured as a "video" type machine, in which game information is displayed on at least one display 24. In a preferred embodiment, the display 24 is a video display. The display may be of a variety of types now known or later developed, such as DLP, CRT, plasma, LCD or others.

The gaming machine 20 preferably includes one or more player inputs which permit the player to interact with the gaming machine 20. Particular configurations of one or more input devices in accordance with the present invention will be described in more detail below. In general, the one or more input devices of the gaming machine allow a player to provide one or more inputs, such as by way of an electrical signal, to the gaming controller or other game content generating device. In that manner, game play is interactive.

In one embodiment, the gaming machine 20 is configured to present a game only upon a player placing a bet, wager, or other payment. Thus, the gaming machine 20 may include means for accepting value, and preferably, monetary value. As illustrated, the gaming machine 20 may include a coin acceptor (not shown). The coin acceptor may be configured to accept coins of one or more denominations. A coin sorter, coin hopper and other coin holding and processing devices may be located in the housing 22 of the gaming machine 20.

The gaming machine 20 may also or alternatively include a bill validator 30. The bill validator 30 may be configured to accept paper money of one or more denominations. A bill stacker and other bill processing and storage devices may be located in the housing 22 of the gaming machine 20.

The gaming machine 20 may also or alternatively include a ticket reader, smart card, credit card or other media acceptor/reader. Such devices may be utilized to obtain information regarding value, such as credit card account information or bar-coded ticket value. In one embodiment, the ticket reader may be combined with the bill validator 30.

When value is provided to the gaming machine 20, the gaming machine 20 may be configured to display information regarding the provided value, such as in the form of "credit" information. This information may be displayed, for example, on a display of the gaming machine or one associated therewith.

The player may utilize inputs to place a wager, bet or provide payment to play a game. For example, a player may depress a "bet one" or "bet max" button to bet or wager one or more credits.

In one embodiment, the gaming machine 20 is configured to award winnings for winning outcomes of games played. The winnings may be paid or provided to the player in a variety of manners. In one embodiment, awards may be indicated in the form of credits. Thus, when a player wins, the total number of credits belonging to them is increased, and the increased amount may be displayed to the player. The player may utilize the awarded credits to play future games.

In another embodiment, the player may be awarded money, or may convert credits to money. As illustrated, the gaming machine 20 may include a coin tray 32 into which coins may be dispensed. The coins may represent a specific award. Alternatively, the player may utilize a "cash out" button or input and be paid the value of their credits in the form of coins.

Other forms of payment may be provided, such as by issuance of a ticket which represents value. As illustrated, the gaming machine 20 includes a ticket printer 34 for printing and dispensing a medium bearing information regarding value.

Preferably, means are provided for controlling the operation of the gaming machine 20, such as the content displayed by the display 24. In one embodiment, that means comprises a gaming controller. The gaming controller may be configured to track game credits (including value provided to the gaming machine and bets placed), generate and/or display game symbols or indicia and determine game outcomes. In one embodiment, a gaming controller includes a processor and a memory. The memory stores software which is executed by the processor. In one embodiment, the gaming controller is located inside of the housing 22 of the gaming machine 20.

The gaming machine 20 illustrated and described is just one embodiment of a device which may be used to present a game in accordance with the invention. Other devices may be utilized. For example, the gaming machine 20 may also comprise a computing device, such as a laptop or desktop computer. Game information may be transmitted via a communication link to a remote player. The communication link may include, for example, the Internet. The game information may be utilized by the remote player's computer, such as by displaying game information on an associated screen. A player may provide input via a keyboard, mouse or other input device.

As described below, in one embodiment, the gaming machine 20 is configured to present a Class II game, and more particularly, a bingo game having one or more results displayed as one or more secondary events, such as a Class III game-type event. In one embodiment, the bingo game information is displayed on the display 24, as is the Class III-type result event. For example, a result of the Class II game may be displayed as a video slot game on the display 24.

In another embodiment, the gaming machine 20 could include one or more mechanical reels comprising bodies having one or more indicia or symbols printed thereon for displaying game information. For example, those reels may be used to display the Class III type event comprising the result of the Class II game. The reels may have a number of positions or locations which bear or do not bear (i.e. comprise a "blank" position) indicia. The indicia or symbols which are borne by the reels may vary.

In such a configuration, means are provided for rotating the reels. In one or more embodiments, the means may comprise motors which are arranged to rotate and stop each reel. Such mechanisms are well known to those of skill in the art. Preferably, a controller is arranged to either turn off the signal to the device(s) effecting the rotation of each or all of the reels or generates a signal for activating a braking device, whereby the reels are stopped. The controller is arranged to stop the reels in a position displaying a combination of indicia as determined by the controller which corresponds to the outcome of the Class II game. The principal of such an arrangement is described in U.S. Pat. No. 4,448,419 to Telnaes, which is incorporated herein by reference.

In other embodiments, the gaming machine 20 may include multiple video displays or other display devices such as rotating wheels, meters and other elements for conveying information regarding one or more aspects of the game. For example, a first video display may display primary game information, while a second display may display the secondary event(s).

One embodiment of the invention will be described with reference to FIG. 2. In accordance with the invention, an input device 100 has multiple positions. Movement of the input device 100 from one position to another is associated with the activation or generation of multiple inputs. In other words, one aspect of the invention is a device which allows a player to generate or provide multiple inputs as a result of movement of an input device. In one embodiment, movement of the input device results in generation of at least two, and preferably three or more, inputs, such as input signals provided to a gaming machine controller.

Figure 2:
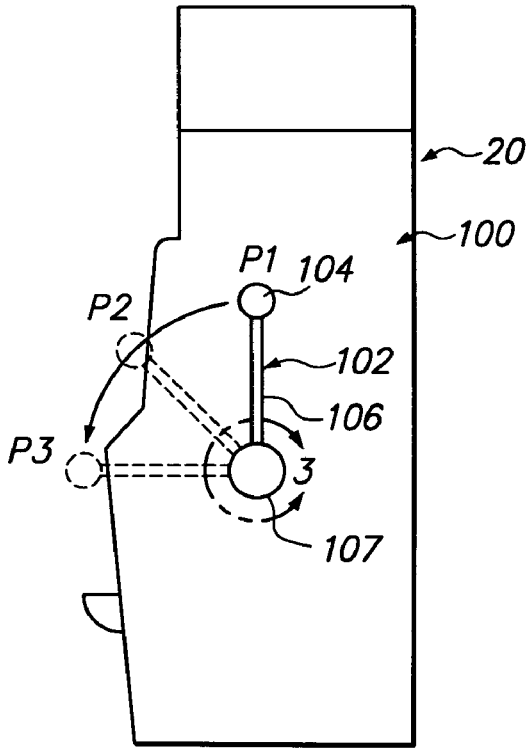
FIG. 2 is a side view of a rotatable arm input device in accordance with an embodiment of the invention, the figure illustrating the arm in a plurality of positions.

FIG. 2 illustrates an input device 100 in accordance with one embodiment of the invention, the input device 100 comprising a rotatable arm 102. As illustrated, the arm 102 comprises a grip or handle 104 connected to a lever 106. The lever 106 is preferably mounted for rotation. In a preferred embodiment, the lever 106 is mounted to a gaming machine, such as described above. The lever 106 may be connected to shaft 107 which is rotatably mounted to a bearing, the bearing connected to and supported by the housing of the gaming machine.

As illustrated, the arm 102 is configured for rotation about its pivot point or connection to the gaming machine from one position P1 to another position P3. In one embodiment, in the position P1 the arm 102 is generally vertically extending, and in the position P3, the arm 102 is rotated towards the front of the gaming machine to which it is attached. As illustrated, in the position P3, the arm 102 is generally horizontally extending. Of course, the position of the arm 102 may vary.

In between the positions P1 and P3 are one or more additional positions of the arm 102. For example, as illustrated, a position P2 lies generally intermediate the positions P1 and P3. Preferably, the positions of the arm 102 correspond to at least two inputs. Thus, as described below, movement of the arm 102 results in activation or generation of at least two inputs.

Figure 3:
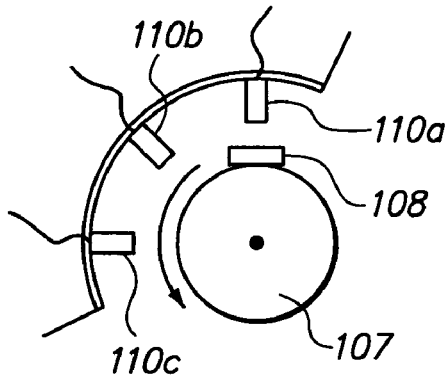
FIG. 3 is an enlarged, cut-away view of a portion of the rotatable arm illustrated in FIG. 2, illustrating various sensors associated with the arm.

Referring to FIG. 3, in one embodiment a trigger 108 is connected to the arm 102 for movement therewith. The trigger 108 may be connected to a shaft or other mount which rotates with the arm 102 as part of its connection to the gaming machine. Preferably, at least one sensor 110, and more preferably, at least two or more pick-ups or sensors 110, are configured to be activated by the trigger 108.

In one embodiment, the trigger 108 may comprise a metal or magnetic element and the sensors 110 may comprise electro-mechanical pickups which sense the trigger 108 when the trigger is located in close proximity thereto.

In one embodiment, as illustrated, a first sensor 110*a* is associated with the arm position P1, a second sensor 110*b* is associated with the arm position P2, and a third sensor 110*c* is associated with the arm position P3. Each sensor 110 is preferably configured to provide an output or signal in response to the trigger 108. In one embodiment, those outputs or signals are provided to the gaming machine as player inputs, such as inputs to the controller of the gaming machine. In addition, in a preferred embodiment, the signal provided to the gaming machine by each sensor 110 is unique, in that it can be distinguished from the output of the other sensors and/or defines a unique event.

In one embodiment, the arm 102 is biased towards its first position P1, such as by a coil spring. A player may rotate the arm from the position P1 to the positions P2 and P3 by grasping the grip 104 and pulling the arm 102 towards themselves. Movement of the arm 102 from position P1 to position P2 preferably triggers the second sensor 110*b*, providing a first input. Further rotation of the arm 102 from position P2 to P3 preferably triggers the third sensor 110*c*, providing a second input. Lastly, release of the arm 102, permitting the arm to be biased back to position P1, preferably triggers the second sensor 110*b* again, as well as the first sensor 110*a*.

Advantageously, while the player experiences only a single event, that of "pulling" the arm of the gaming machine, the movement of the arm 106 results in the activation or generation of multiple input events. In this manner, a single action by the player can be used to provide multiple player inputs to the gaming machine. Some specific example of use of the arm 102 will be described in more detail below.

It will be appreciated that as the arm 106 rotates or moves between the end positions P1 and P3, the arm technically moves through an infinite number of intermediate positions. Thus, the exact locations of one or more intermediate positions may vary, as may their number and the number of associated sensors and thus inputs.

Figure 4:
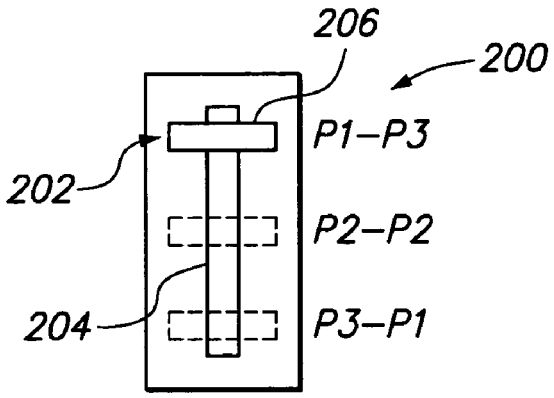
FIG. 4 illustrates a slider input device in accordance with an embodiment of the invention, the figure illustrating the slider in a plurality of positions.

FIG. 4 illustrates another embodiment input device 200 in accordance with the present invention. This device 200 comprises a slider 202. The slider 202 is preferably configured for translating or linear movement along a track or slot 204. Preferably, the slider 202 includes a button or grip 206 which may be grasped by a player. In one embodiment, the button 206 is connected to a stem (not shown) which extends through the slot 204. The stem may engage a track along which the stem may travel, as is known in the art of slider-type switches.

In accordance with the invention, the slider 202 may be moved from a position P1 to a position P3. As illustrated, these positions P1 and P3 comprise the terminus points of the track or slot 204. Between the positions P1 and P3, the slider 202 moves through at least one additional position P2.

In a preferred embodiment, at least two of the positions of the slider 202 are associated with or activate inputs. Preferably, these inputs are discrete or unique. Thus, while not shown, in one embodiment the stem of the slider 202 may be configured to trigger a first input associated with position P1, a second input associated with position P2 and/or a third input associated with position P3. As with the rotatable arm disclosed above, the slider 202 may be configured to trigger additional or other combinations of inputs. For example, a position P4 (not shown) may also be provided between points P1 and P2, that position P4 having an associated input. The slider 202 may also be configured such that an input is not associated with a particular position, such a position P1, while inputs may be associated with other positions.

In one embodiment, the slider 202 is configured for movement in the direction of the position P1 to the position P3, and in reverse. In the case of reverse movement, the designation of the inputs and positions may be reversed, in a manner described in more detail below.

Preferably, movement of the input device of the invention is used to provide multiple inputs to a gaming machine. One particular embodiment of the invention will now be described in detail.

One embodiment of the invention is a method of providing player input to a gaming machine configured to present a Class II game and, more particularly, a bingo-based game. In one embodiment, the game is configured to require multiple player inputs in order for the player to play the game. In a preferred embodiment, the player must provide at least one input to initiate the game, at least one input to "daub" balls, and at least one additional input to "daub," "claim" or otherwise play the game.

Figure 5:
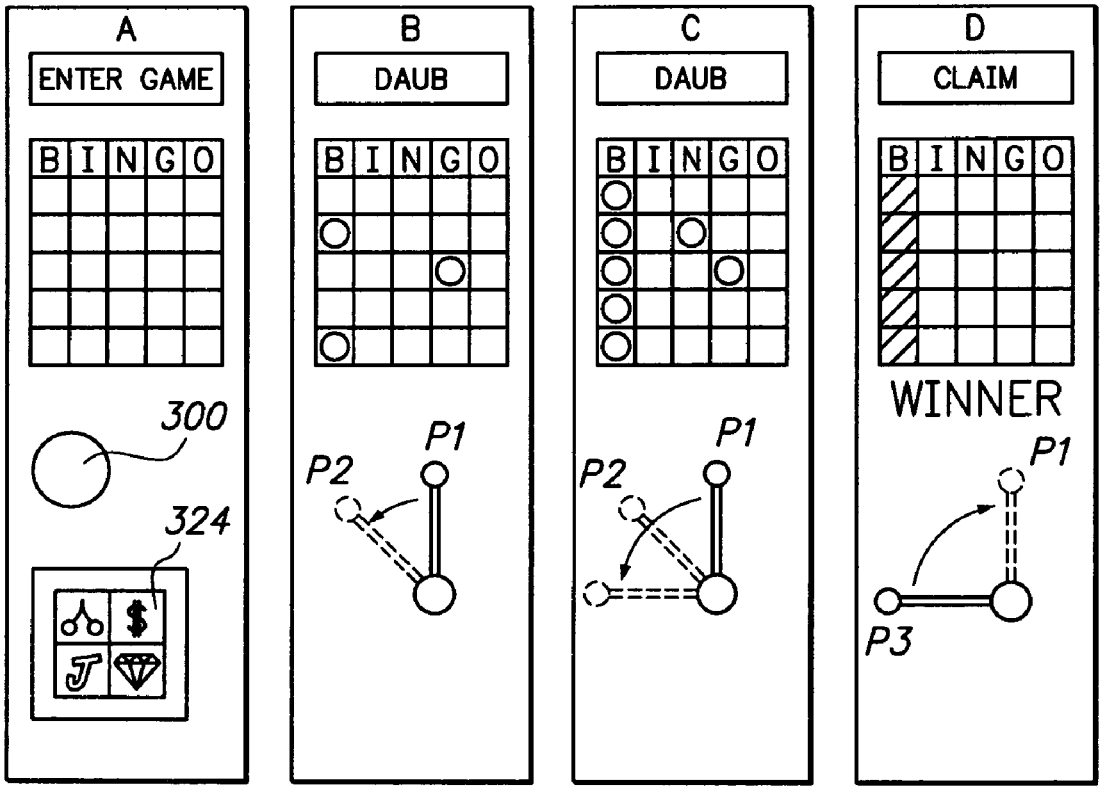
FIG. 5 illustrates a plurality of game steps and associate inputs or actions in accordance with one embodiment of a method of playing a game in accordance with the invention.

In one embodiment of a game, a player is required to place a wager or bet in order to play the game. As illustrated in FIG. 5, in one embodiment, the player must provide an input at a step A in order to request to play or enter a game. In one embodiment, this input is provided via a first input device which is actuated by the player. For example, in one embodiment the player might depress a button 300 located on the gaming machine or the player might be permitted to make a selection on a touch-sensitive screen or display 324 of the gaming machine.

Figure 6:
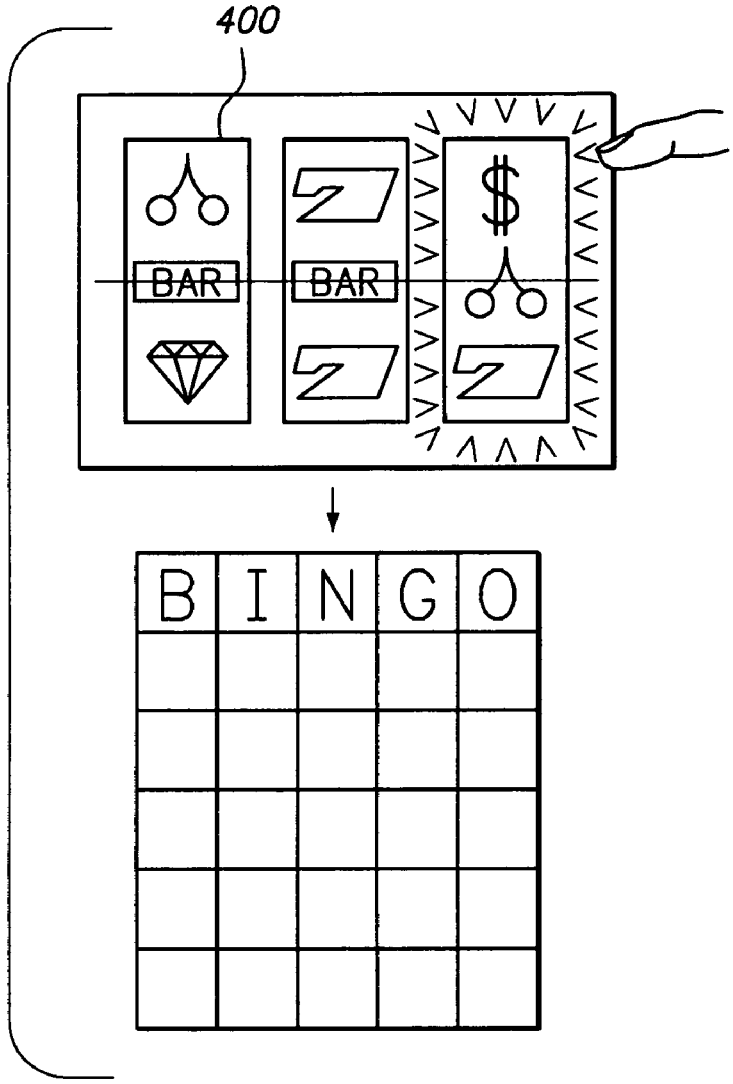
FIG. 6 illustrates a touch screen input device and associated event in accordance with an embodiment of the invention.

FIG. 6 illustrates one particular embodiment of a version of the game where one player input is via a touch-sensitive screen. In a preferred embodiment where the game presented to the player is a Class II bingo-based game, an event or information which is secondary to the bingo game is displayed to the player. For example, where the outcome of the bingo game is going to be represented to the player as a spinning-reel event, a plurality of simulated reels 400 may be displayed to the player. The player may be requested to touch an area of the display in the area where one or more of the reels 400 are displayed in order to start the reels spinning.

Importantly, in an embodiment of the invention, this input is treated as a request by the player to play or enter a game. Thus, as one aspect of the invention, a player provides an input associated with a first event (e.g. a request to play or enter a game), but that input is utilized as an input to a second event (e.g. the rotating of reels used to display the outcome of the game).

Another example will be described with reference to FIG. 5. As illustrated, before a game is present to a player, the gaming machine may be configured to display to the player a set of lucky symbols. A player may be requested to select one of the lucky symbols which will be used in game play. In accordance with the invention, this input is treated as a request by the player to play or enter a game.

Currently, the definition of a "bingo" game is that the game requires at least two players to play the game. As such, when a player provides the "enter game" input, it is determined if there is at least one other player who also wishes to play the bingo game. Though not described in detail herein, a plurality of gaming machines presenting these types of Class II games are thus normally associated with one another, such as through a host or server. This configuration is known in the art. In general, when a player makes a request to play a game, that request is forwarded to the host, which determines if it has received other such requests from other machines. If so, the game starts. If not, the host waits until the minimum number of players is achieved.

Once the minimum number of players who desire to play the game is achieved, if any, referring to FIGS. 5 and 6, each participating player is provided with a set of player symbols, such as numbers. In a preferred embodiment, the symbols are associated with a game card. In one embodiment, the game card is a bingo card having spaces bearing symbols such as numbers. In a gaming environment where the game is presented on an electronic gaming machine such as that described above, the game card is preferably electronically displayed.

After each player is assigned one or more game numbers, such as associated with game cards, game numbers (or other symbols, when the cards bear other symbols) are drawn. In one embodiment, the game numbers are randomly selected, such as by a random number generator (RNG) associated with the host or server.

As is known, the object of the game is for the player to match game numbers to the numbers on their card(s) to achieve a pattern or number of matches. The numbers may be drawn or generated one at a time, or in groups or sets containing one or more numbers. One or more patterns of matching numbers or symbols are designated game winning combinations. For example, a game winning patterns may be "four corners," "cover-all," "a diagonal" or others.

As game numbers are drawn, the object is to match the game numbers to numbers on the game cards. In one embodiment, the game numbers are displayed to the players. For example, the game numbers may be transmitted from the server to the gaming machines and displayed on the displays thereof.

As is known, the game numbers may be selected in a variety of other fashions. In a traditional manner, the numbers may be printed on balls, and the balls may be randomly drawn. As indicated above, in an electronic game environment, the numbers may be selected with a random number generator of the host or server.

In one embodiment of the game, a player is required to "daub" matching numbers, as indicated in a step B of the game illustrated in FIG. 5. In one embodiment, the step of daubing results in a confirmation of a match and may include the display of the match on the player's game card. In accordance with the invention, a player must provide an input in order for the "daubing" step to be performed, and thus for matching numbers to be indicated so that a player has an opportunity to win the game. In one variation of the game, if a player does not provide this input, the matching numbers are not confirmed or daubed, thus preventing the player from receiving a winning outcome.

In one embodiment of the invention, this input is provided by an input device associated with the gaming machine. Preferably, the input device is a multi-position input device in accordance with the present invention. For example, as illustrated in FIG. 5, the input device may be the rotatable arm of the present invention.

In accordance with this embodiment, the player moves the rotatable arm, such as from the position P1 to P2, as illustrated in FIG. 5. When the rotatable arm is rotated and reaches position P2, an input signal is generated and provided to the gaming controller which indicates that the player wishes to have matching numbers "daubed."

In one embodiment of the game, additional inputs are required in order for the player to complete the game, receive any potential winning outcomes and be entitled to collect any winnings. Preferably, these additional inputs are provided by movement of the same input device.

For example, in one implementation of Class II bingo-based games as described above, game play continues until a game ending pattern is achieved by a player. Players may be awarded, however, for other patterns which are designated as winning patterns but which are not game-ending. In such a configuration, the number of balls which are initially drawn (or game numbers which are selected) are preferably fewer in number than the number of balls which are required to achieve the game-ending pattern. This ensures that while one or more players may achieve winning patterns after the first ball draw, the game will continue to at least an additional ball draw.

In accordance with this embodiment, in a step C of the game, the player is required to provide an input to daub game numbers associated with second or subsequent additional ball draws as against matching numbers on the player's card. In a preferred embodiment, this input is accomplished by movement of the same input device as which provided the initial daub input. In one embodiment, as illustrated in FIG. 5, movement of the rotatable arm from the position P2 to P3 causes an input signal to be generated. This input signal preferably corresponds to an instruction to the gaming machine controller to perform the second "daub" action.

Lastly, in one version of the game, a player is required to provide a "claim" input in order to claim any winnings associated with winning patterns. Preferably, as illustrated in FIG. 5, this input is provided by further movement of the input device. In one embodiment, release of the rotatable arm and movement of the arm from the position P3 back to its resting position P1 results in generation of an input signal. This input signal preferably corresponds to an instruction to the gaming controller to "claim" the player's winnings.

As indicated above, the result of the game may be represented or displayed as one or more secondary events. For example, the outcome of the game may be displayed or represented as a slot-type event, i.e. has the appearance of a Class III slot game. Of course, in this arrangement, the outcome of the slot event is known from the outcome of the base bingo game. For example, if the player received a winning bingo pattern having an associated award of 100 credits, the slot event may represent the spinning and stopping of reels to a set of symbols corresponding to a 100 credit combination.

It will be appreciated that the game need not have all of the steps and associated inputs just described, and the game may require additional inputs. For example, the game may require the player to provide a "daub" input for each successive ball or game number draw, and there may be more than two such draws. It will also be appreciated that the various inputs may be by other inputs devices and by other movements of the rotatable arm just described (for example, the various inputs may be associated with other positions or movements of the arm other than as specifically just described).

Additional aspects of the invention will now be described in detail, it being understood that the invention has wide applicability to other types of games and to a variety of input device configurations.

First, various other input devices other than specifically described above are contemplated. As indicated, one aspect of the invention is a movable input device, movement of which is associated with the generation of at least two inputs or input signals. The embodiment input devices illustrated in FIGS. 2 and 4 are configured solely to rotate or translate, but other input devices could be configured for other forms of movement. The input devices which are specifically described and illustrated may also vary in their configuration. For example, the rotatable arm need not include a lever and a grip, and the configuration of the inputs or sensors may vary. A wide range of methods and apparatus for generating a signal may be applied to the multiple-position, multiple input device of the invention, including direct contact and close proximity signal generation. It is also noted that the input device might have only one sensor but be configured to provide multiple inputs. For example, an input may be generated when a rotatable arm passes a sensor when rotating from its start to its rotated position, and then a second input may be generated when the arm passes that same sensor moving back to the start position.

It is noted that the term "input" is used herein in that a player is providing an input, instruction or the like. The "input" may be considered an "output" when viewed from the perspective of the input device, in that the input device may be configured to provide or generate a signal which is "output" to a gaming controller or other device.

Figure 7:
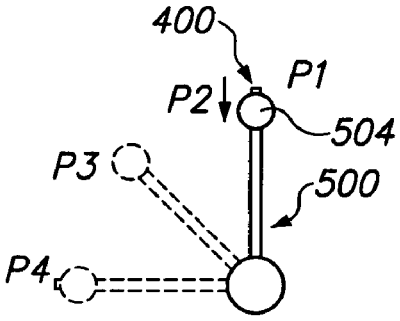
FIG. 7 illustrates a rotatable arm input device having a secondary button input in accordance with yet another embodiment of the invention.

FIG. 7 illustrates an embodiment input device which is configured for two types of input or movement. FIG. 7 illustrates a rotatable arm 500 having an associated button 502 or secondary input. In the embodiment illustrated, the button 502 comprises a push-button which is associated with the knob or handle 504 of the arm 500. In this embodiment, one input may be defined by the push of the button 502 and one or more additional input may be defined by the movement of the arm 500.

In one embodiment, the arm 500 may be locked into a fix position until a player pushes the button 502. For example, a player may depress the button 502 in order to initiate a game. The player may then be permitted to rotate the arm 500 through multiple positions to activate additional inputs. In this configuration, a time delay may be effected between the first and subsequent inputs, as a result of the player first being required to depress the button 502 and then not move the arm 500 until it is unlocked. Such a configuration has particular utility to a Class II bingo-type game as described above where there may be a delay between when a player enters the game and when the game starts with a ball draw.

As indicated, the button 502 is preferably mounted to the arm 500, such as at the knob 504 thereof. The button 502 might be mounted in other locations and could take various forms. In one embodiment, it is possible for the button 502 or another input to be located elsewhere, such as on the button panel of the gaming machine, which button still serves as an input, including to "unlock" the arm to permits rotation.

Various means may be used to lock and unlock the arm 500, as known to those of skill in the art. For example, a pin may be moved back and forth into the path of the arm using a spring and solenoid. The pin may be biased by the spring into a position in which it blocks movement of the arm and, when the button is depressed, an electrical signal may be sent to the solenoid to draw the pin rearwardly, thus releasing the arm.

Figure 8:
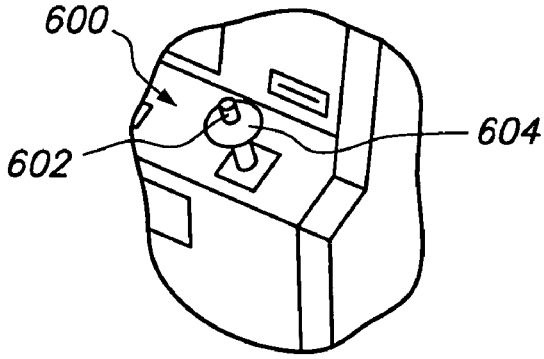
FIG. 8 illustrates a joystick input device having a secondary button input in accordance with another embodiment of the invention.

Another embodiment of a device having two types of inputs is illustrated in FIG. 8. FIG. 8 illustrates a joystick 600 type input device, the joystick 600 also including a button 602. In one embodiment, the joystick 600 includes a knob 604, the button 602 mounted to the knob 604. The joystick 600 may be moveable between various positions, including up, down and side-to-side. Various of the positions of the joystick 600 may be associated with particular inputs. A player may be instructed to move the joystick 600 to various positions or through various patterns in order to effect one or more inputs. As also indicated, in a preferred embodiment, one input may be effected using the button 602. As with the arm 500 described above, in one embodiment the position of the joystick 600 may be locked until the player depresses the button 602.

In one embodiment, as illustrated, the joystick 600 may be located on the button panel of the gaming machine. The joystick 600 or other similar types of input devices (such as a movable pistol-grip type lever including a secondary "trigger" or other input, whether for actuation by a thumb, finger, palm or even one or more input devices for actuation by even a foot of the user) may be located in a variety of positions of the gaming machine.

The method and input device of the invention has particular applicability to games where multiple player inputs are required and, even more applicability to games where multiple inputs are required in succession or sequence to one another. Besides a Class II bingo game such as described above, however, the method and input device may have applicability to other games and events, including Class III type games such as slot and video poker games.

FIG. 5 illustrates one particular embodiment where at least four player inputs are required. It will be appreciated that the method and input device of the invention have applicability to games where a greater or lesser number of player inputs are required. For example, in some Class II bingo-based games, after a player enters a game, a player is only required to "daub" and "daub/claim," such that there are three main player required inputs. In that event, the three-input defining rotatable arm or other input device might be used to provide all three inputs.

As described above, in the embodiment game and method illustrated in FIG. 5, a first input device is used to provide the "enter game" input, and a second input device is used to provide the additional inputs. As indicated above, some games such as bingo-based Class II games require more than one player. Thus, under proposed regulations for Class II bingo-based games, a time delay or "window" may be required for forming a group of players to which the game will be presented. In this configuration, after a player provides the "enter game" input, a time delay may occur before the game is actually initiated. In that event, it is desirable for the next game play input to similarly be delayed until the game has actually started.

In the embodiment illustrated in FIG. 5, this "delay" is effected by having the player provide a first input through a first input device and then provide the additional inputs through a second input device. The necessary "delay" may then be accomplished by the time necessary for the player to activate the two input devices (i.e. reaching from a button on the panel to a side-mounted arm on the machine) and/or by spacing instructions which are provided to the player to provide these inputs. For example, the player may be instructed to touch one of the reels displayed on the screen, as illustrated 6. The gaming controller may then cause one or more of the reels to start spinning. After a delay effected by this "reel spin" action, the player may be instructed to provide the "daub" or additional input(s), at which point the player may rotate the arm or provide the additional input(s).

In one embodiment, the inputs may be provided through the same device even though a delay between in the inputs may be required. For example, referring to the input device illustrated in FIGS. 7 and 8, the first input may be provided via the button 502/602. At that time, as indicated above, the arm 500/joystick 600 may actually be locked to prevent movement. The arm 500/joystick 600 may then be released when the player is required to provide the additional inputs.

In another embodiment where the input device is an arm, the arm may be configured to rotate slowly against the player's pull. The speed of rotation of the arm may be limited to ensure that the time between one or more of the inputs is a minimum period of time. Of course, the speed of rotation may actually be varied, such as where the delay period varies. In the case of a joystick, the player may be required to move the joystick between varied positions, thus necessitating time for the various movements correlated to the time delays in the game.

In one embodiment, the user may be permitted to make or provide a plurality of inputs, which inputs are "stored." For example, at the beginning of a game which requires a minimum number of inputs in order for the player to complete the game, the player may be permitted to provide those inputs even before certain events for which inputs are required have occurred. In the above-referenced example of a Class II bingo-type game, a player may be permitted to rotate the arm at the beginning of the game to enter a game and provide the "daub," "daub" and "claim" inputs. In that instance, the player's input of the "daub," "daub" and "claim" inputs may actually occur before bingo balls or game numbers are drawn. However, the player's previous inputs may be stored or otherwise be received and then associate with those actions when they occur later in the game.

As indicated, in a preferred embodiment of the invention, movement of an input device from a first position to a second position preferably results in the generation of two inputs. In one embodiment, the first and second positions may actually be the same location. For example, in the case of a rotatable arm, the arm may be moved from a starting position to a rotated position, thus generating a first input/signal, and the moved back (either by the player or automatically) to the starting position, thus generating a second input/signal.

In one embodiment, different signals may be generated when the input device is located at the same position, such as depending upon the direction of movement of the device. As indicated above, for example, a rotatable arm may pass a position P2 when being moved from a starting position P1 to a rotated position P3, and then may pass that same position P2 when being moved back from the position P3 to the position P1. In one embodiment, one input may be provided when the arm is at the position P2 moving from the position P1 to the position P3, and another input may be provided when the arm is at the position P2 moving from the position P3 back to the position P1. Those inputs may be discrete and comprise different signals or comprise signals which are interpreted by the gaming controller as associated with separate events. In this example, movement of the arm from the position P1 though the position P2 to the position P3 and back to the position P1 may result in the generation of signals or inputs corresponding to the arm being located at the positions P2, P3, P2 and then P1. These four inputs or signals may be correlated, for example, to the required inputs of "enter game," "daub," "daub" and "claim" in a Class II game such as that described above.

In other embodiments, input signals may not be generated depending on the motion of the input device (e.g. no input signal is generated when the arm is rotating back to the position P1 from position P3) and/or one or more signals may be "ignored."

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of presenting a game at an electronically-controlled gaming machine comprising the steps of:

accepting a first input from a player to initiate and enter a game;

presenting a game to a player at a gaming machine including displaying a game card to said player, one or more player numbers associated with said game card;

generating a first set of one or more game numbers;

accepting a second input from a player to daub said game card and indicate matches of any game numbers from said first set of game numbers with player numbers;

generating a second set of one or more game numbers;

accepting at least a third input from a player to complete play of said game; and determining if said player received any winning game combinations;

wherein at least two of said first input, said second input and said at least a third input are provided by said player moving a multi-position input device continuously along a path from a first position to a second position.

2. The method in accordance with claim 1 wherein said multi-position input device comprises a rotatable arm movable from a first position P1 to a rotated position P2 and back to said first position P1.

3. The method in accordance with claim 1 wherein all of each of said first, second and at least one third input are provided by a player moving said multi-position input device.

4. The method in accordance with claim 1 wherein said second input and said at least one third input are accepted before said first and second sets of game numbers are generated.

* * * * *